US005327500A

United States Patent [19]

Campbell

[11] Patent Number: 5,327,500

[45] Date of Patent: Jul. 5, 1994

[54] CERUMEN BARRIER FOR CUSTOM IN THE EAR TYPE HEARING INTRUMENTS

[76] Inventor: Donald E. K. Campbell, 245 Arnold La., Winter Springs, Fla. 32708

[21] Appl. No.: 994,531

[22] Filed: Dec. 21, 1992

[51] Int. Cl.[5] ..... H04R 25/00

[52] U.S. Cl. ..... 381/68.6; 381/68; 381/69

[58] Field of Search ..... 381/68.6, 69, 69.2, 381/68.7, 68, 68.2, 68.4; 181/129, 130, 135

[56] References Cited

U.S. PATENT DOCUMENTS

| | | | |
|---|---|---|---|
| 3,061,689 | 10/1962 | McCarrell et al. | 381/68.6 |
| 3,852,540 | 12/1974 | Diethelm | 381/68.6 |
| 4,451,709 | 5/1984 | Waxman . | |
| 4,532,649 | 7/1985 | Bellafiore . | |
| 4,584,437 | 4/1986 | Giannetti | 381/68.6 |
| 4,716,985 | 1/1988 | Haertl | 381/68.6 |
| 4,870,689 | 9/1989 | Weiss . | |
| 4,879,750 | 11/1989 | Nassler . | |
| 4,945,569 | 7/1990 | Kulman . | |
| 4,953,215 | 8/1990 | Weiss et al. . | |
| 4,972,488 | 11/1990 | Weiss et al. . | |
| 4,984,277 | 1/1991 | Bisgaard et al. . | |
| 4,987,597 | 1/1991 | Haertl . | |
| 5,099,947 | 3/1992 | Guggenberger et al. . | |
| 5,105,904 | 4/1992 | Olsen . | |
| 5,166,659 | 11/1992 | Navarro . | |

OTHER PUBLICATIONS

"If the CF-10 Stops Working, We'll Come to Your Aid"-Oto-sonic, Inc.

"Application Notice"-Audine Hearing Instruments,Inc.

Wax Guard Instructions for Service and Replacement-Nu-Ear Electronics.

"Improved Wax Guard" Article from Hearing Instruments, vol. 43, No. 9, 1992 (p. 47).

"The Cerumen Filter System*" Ad from GN Danavox (p. 35).

*Primary Examiner*—Curtis Kuntz

*Assistant Examiner*—Huyen D. Le

[57] ABSTRACT

A cerumen barrier for a custom, in the ear type hearing instrument which consists, in combination, of a sound outlet base and a barrier door which prevents ear wax from reaching and damaging the internal components of a hearing instrument, particularly the transducer, in an arrangement which facilitates an accelerated and simplified attachment to the hearing instrument as compared with the state of the art. The sound outlet base comprises a cylindrical component, incorporating a bore insertable into the sound outlet port, and a counterbore, which joins to the male connector on the barrier door.

11 Claims, 3 Drawing Sheets

CERUMEN BARRIER FOR CUSTOM IN THE EAR TYPE HEARING INTRUMENTS

BACKGROUND OF THE INVENTION

1. Field of the Invention

The invention relates to ear wax barriers for custom in the ear hearing instruments in accordance with the general definition of patent claim 1.

2. Technical Background

Cerumen traps which prevent the ingress of ear wax into the hearing instrument and other cerumen traps which reduce the likelihood of ear wax blocking the sound outlet are already known.

From U.S. Pat. No. 4,972,488 which describes clearly detailed barrier designs which use a fine mesh screen in the sound channel wherein if sufficiently small screen holes are used, will eventually clog with wax and conversely when mesh is made with wider screen holes, wax will eventually migrate across the screen and damage the transducer. Such cellular synthetic screens can increase acoustic impedance between the transducer and the ear drum which may modify the frequency response and acoustic gain of the hearing aid device.

From U.S. Pat. No. 5,105,904 arrangements which utilize wax filters or caps necessitate the need to replace such filters when clogged with wax. Clogging can occur gradually depending upon variances of cerumen production in different hearing instrument wearers or immediately upon inserting the hearing instrument into the ear canal.

In the gradual clogging process, the wearer's perceived sound quality may gradually worsen evidenced by acoustic feedback or lack of output. The wearer must purchase or otherwise obtain additional filters and tools for replacement of the filters. First the wearer needs to visually verify the filter or screen needs changing or the cap is clogged. Visual acuity and finger dexterity are necessary for proper replacement and realignment of such filters or caps. Other mechanical, internal defects can develop in nearing instruments which display the same failure characteristics as wax clogging does, thereby leading to frustration when filter replacement does not alleviate an internal failure. Often times, it is more desirable for a trained hearing aid professional to clean the hearing instrument and verify specifications in order to reduce the wearer's frustration and chance of improper installation resulting in filters, screens or caps falling off the unit or into the wearer's ear canal. Thus it is desirable to have a barrier which does not need replacement over the life of the hearing aid.

If the filter, screen, or cap clogs when inserting the hearing aid, the filter acts as a wax "scoop", particularly if the wearer's canal diameter is small in respect to the diameter of the filter. Thus it is desirable to keep such barriers as small as possible to reduce the incidence of insertion clogging.

Three piece barrier systems are known which consist of a metallic hinge pin, inserted into a sound outlet base—typically made of Acrylonitrile-Butadiene-Styrene resin, "Cycolac", Tenite, Poly amide, or similar injection molded thermoplastic—and a barrier door, also made of a similar plastic, which attaches to the hinge pin.

The sound outlet base incorporates a bore to allow the outlet of sound from the transducer, and a small detent cavity which accepts a latch mechanism from the barrier door, and two small cavities parallel to the base which accept the hinge pin.

The sound outlet base perimeter is square. The side opposite the hinge pin is flat. This flat side is affixed to the tip of the hearing instrument shell (perpendicular to the long axis of the ear canal), typically with Methyl Methacrylate, Cyanoacrylate "super glue", or similar bonding agent of the aforesaid plastics. The square base must be trimmed and then buffed to match the contour of the tip of the wearer's hearing aid. The buffing process can disrupt the placement of components within the shell often resulting in non-conforming specifications such as acoustic feedback, or shorting. The buffing process can also reduce the size of the canal tip resulting in an improper fit for the hearing aid wearer. Thus a barrier is desirable which could eliminate this trimming process.

This three component barrier system utilizes the barrier door to prevent clogging of the sound outlet during insertion. The barrier door has a hinge at one end to rotate about the hinge pin and a latch at the other end to keep the door closed. Thus it is the barrier door hinge in combination with the hinge pin which attaches the barrier door to the sound outlet base and it is the latch on the barrier door which keeps the barrier door closed and parallel to the sound outlet base.

The barrier door when snapped onto the hinge pin and closed, leaves a clearance so that sound is not appreciably impeded once it exits the sound outlet bore. Such a clearance is desirable for a wax barrier which is large enough not to reduce the transducer output or significantly change the acoustic impedance of the hearing instrument.

Effective in the way it prevents wax from being scooped into the sound outlet, and in the elimination of replacement filters, it requires periodic cleaning when ear wax collects near the clearance between the base and door. The cleaning process is usually accomplished by unlatching and opening the barrier door, and then brushing away wax with a small brush. Difficulties arise when the plastic door hinge fatigues during the life of the hearing instrument, due to periodic cleaning (typically daily), and thus lose grip on the hinge pin. The wearer then risks the possibility of losing the small door or even an unhinged door falling into the ear canal while wearing the hearing instrument. Thus it is desirable for a barrier unit which minimizes fatigue on any such hinge or latch which connects the barrier to the hearing instrument.

Such barriers which, when open, extend the effective length of the hearing instrument (along the long axis of the ear canal), can possibly injure a wearer's ear drum if the end of the hearing instrument is already close in proximity to the ear drum. Thus it is desirable for a barrier which poses no threat of injury to the wearer's ear drum, particularly if the barrier is inserted into the ear canal when open.

SUMMARY OF THE INVENTION

A principal aspect of the present invention is an improved cerumen barrier for custom in the ear hearing instruments. The invention described is primarily for use with hearing aids. However, said invention should not be limited to hearing aids, as any otoplastic device in which prevention of cerumen intrusion is desired could benefit from this invention.

The present invention is comprised of two components. The sound outlet base and the barrier door. The sound outlet base is inserted and secured into the sound outlet port of the hearing aid shell. The barrier door is inserted into the counter-bore of the sound outlet base. The barrier door and base can be made of metal, fiberglass, high flow polycarbonate, glass filled nylon, or other injection molded thermoplastic, but this is not meant to constrain the manufacture of said invention in any material or process wherein, if realization of said invention occurs according to the general definition of patent claim 1, can accomplish the same function. For the preferred embodiment we have selected Nylon Type 66 glass filled.

The sound outlet base comprises a cylindrical component defining a central axis for the passage of sound is glued into the sound outlet port of the hearing aid shell prior to assembly of the hearing aid components. The sound outlet base requires no trimming after inserting into the shell as the perimeter is minimized in respect to the outside diameter of both the cylindrical component of sound passage and the counter-bore.

An object of the present invention is a barrier which does not require replacement over the life of the hearing instrument thereby preventing the wearer from losing or improperly installing said barrier, and the barrier consequently falling off the hearing aid or into the ear canal.

Another object is a barrier which reduces clogging of the sound outlet particularly during insertion of the hearing instrument.

Another facet of the present invention is a barrier which is easily manufactured and assembled utilizing no trimming or buffing process thus reducing labor and material costs for hearing aid manufacturers and ultimately improving service for the hearing impaired.

Another facet is a barrier which prevents clogging and resists the migration of ear wax into the hearing aid transducer without significantly affecting the acoustic impedance between the transducer and the ear drum.

Another aspect of the present invention is a barrier which minimizes the fatigue on any hinge or latch which connects said barrier to the hearing instrument.

Another aspect is a barrier, which poses no threat of injury to the wearer's ear drum, particularly if the barrier is inserted into the ear canal when open.

BRIEF DESCRIPTION OF THE DRAWING

A preferred embodiment of the present invention and additional features and objects of said invention will be explained in more detail and better understood by reference to the following detailed description with reference to the enclosed figures.

DETAILED DESCRIPTION OF THE PREFERRED EMBODIMENT

Figure 1:
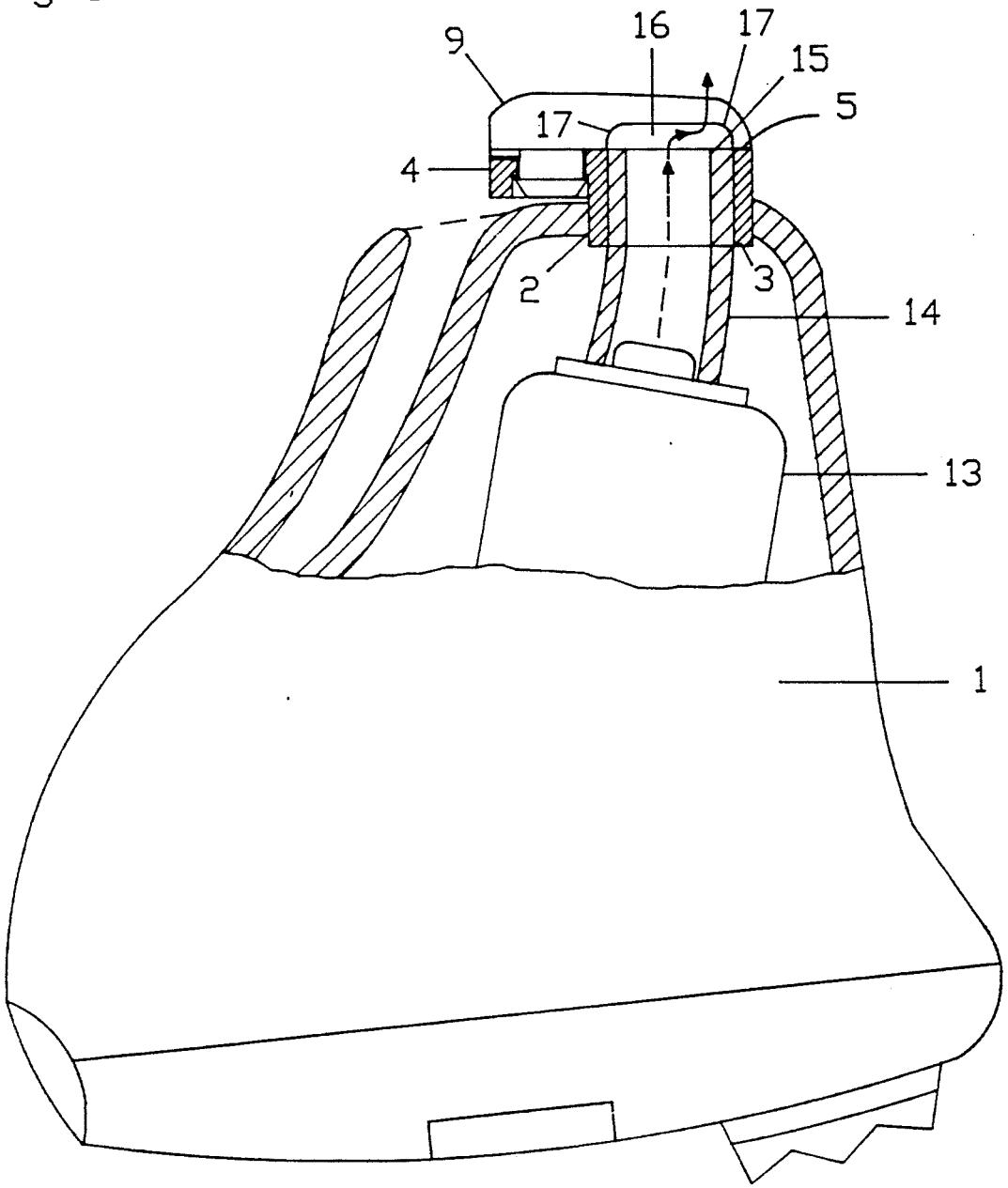
FIG. 1 is a highly magnified depiction of a custom in the ear hearing instrument, in a partial cross-sectional cut away view of the preferred embodiment of the present invention.

FIG. 1 shows in greatly modified form, a custom made shell housing 1 for an in the ear hearing instrument in Which parts essential to the invention are illustrated. The dimensions of the preferred embodiment herein described follow. Of course, other embodiments are possible, and these dimensions should not be read to limit the scope of the present invention. Indeed differences in individual ear sizes and manufacturing materials could accommodate different size wax barriers.

Figure 2:
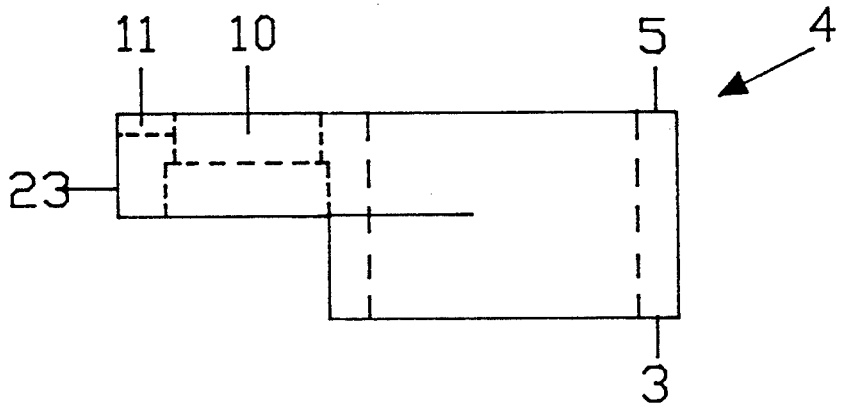
FIG. 2 is a side view of the sound outlet base.

As can be seen from FIG. 1 in conjunction with FIG. 2, the output port of the shell 2 is where the cylindrical component 3 of the sound outlet base 4 of the present invention will be inserted. The diameter of the output port of the shell is 0.106 inch made by drilling a hole in the tip of the shell with a bur or other tool well known to those who specialize in hearing aid shell assembly. The cylindrical component 3 of the sound outlet base 4 is glued into the output port of the shell 2 using Cyanoacrylate or other similar bonding agent.

The sound outlet base 4 of FIG. 2 is flat on the top side 5 which opposes the side extending the cylindrical component 3 which inserts into the shell. The long axis of the sound outlet base 4 is 0.1650 inch. From FIG. 3 one end of the base 7 has a radius of 0.0515 inch and the other end 6 has a radius of 0.0380 inch.

The cylindrical component of sound passage 3 is 0.079 inch inside diameter and 0.103 inch outside diameter; therefore it has a wall thickness of 0.012 inch. The depth of cylindrical component 3 is 0.060 inch measured from the top of the base 5 to the tip of the cylindrical insert. Adjustments to the diameter of the cylinder 3 are considered obvious by the inventor and can be made to increase or decrease the size of said invention and may affect the acoustic properties of the output of the hearing instrument.

Figure 4:
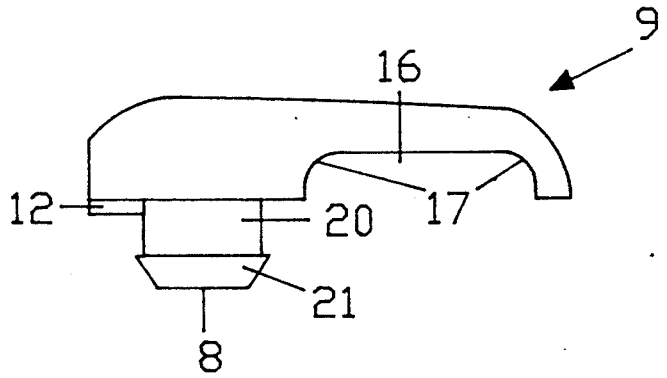
FIG. 4 is a side view of the barrier door.

From FIGS. 2 and 4 the segment of the sound outlet base which accepts the male connector 8 of the barrier door 9 is the counterbore 10. The inside diameter of this counter-bore is 0.042 inch and 0.048 inch respectively. The smaller bore is 0.014 inch deep and the larger bore is 0.016 inch deep with a minimum wall thickness of 0.014 inch. In alternative embodiments, adjustments to the depth and radius of the counter-bore 10 can be made to increase or decrease the torque which is needed to rotate the barrier door 9 and the amount of force which must be applied to insert the barrier door.

Shown in FIGS. 2 and 4 on top of the sound outlet base 5 is a cavity 11 which will accept a projecting detent 12 of 0.004 inch radius from the barrier door 9. This detent will align the barrier door with the base. Of course in alternative embodiments, similar detents could be placed at any surface area which is in contact with both the sound outlet base 4 and the barrier door 9 thereby creating the proper alignment of door and base. Also, a greater number of detents could be employed to increase the torque needed to rotate said barrier door without limiting the intentions of present invention in accord with patent claim 1.

Also, said invention could be realized by a mechanical reversal. The detent cavity could be placed on the barrier door while the sound outlet base comprised the projecting detent. Although the detent 12 employed in preferred embodiment is a radial projection on the barrier door 9 of FIG. 4, indeed there are many well established detents used in plastics and injection molding which would of course not limit the scope of said invention.

After the sound outlet base 4 of FIG. 2 is inserted into the shell, the hearing aid components are installed in the housing 1 as shown in FIG. 1. The transducer 13 is shown with plastic tubing 14 extending from its port through the cylindrical insert 3 to the top surface of the sound outlet base 5. This tubing was first glued to the transducer 13 port and then, to secure the transducer's location in the housing 1, the opposite end of the tubing 14 is glued to the inside surface area of the cylindrical component 3. The tubing which extends beyond the top surface of the sound outlet base 5 is then trimmed flush with the top of the sound outlet base. This extra tubing is usually trimmed with a razor blade thus making it desirable to have the top of the base 5 flat so that no detents or hinge pins would be cut by the blade. The direction of sound output from the transducer 13 is indicated by the arrows shown in FIGS. 1 and 6.

Figure 6:
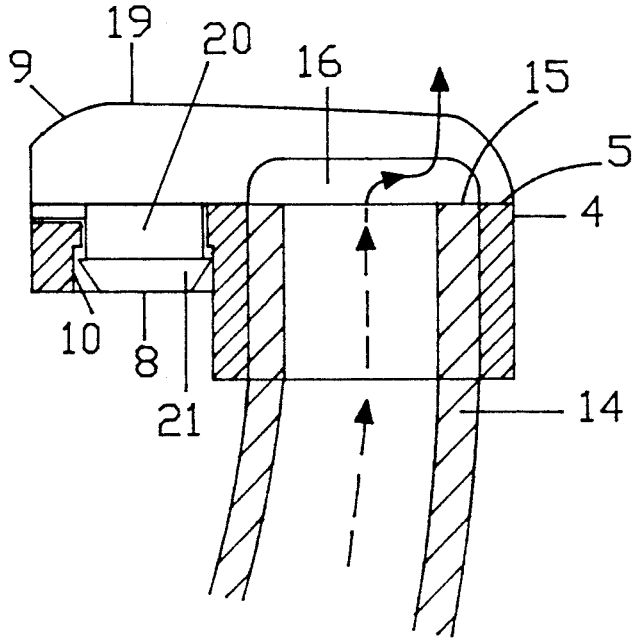
FIG. 6 is a cross-sectional view of the sound outlet base shown in FIG. 4 with the barrier door of FIG. 2 inserted.

Once final quality control tests insure the unit operates Within tolerance, the male component 8 of the barrier door 9 is inserted and aligned into the counter-bore 10 as shown in FIG. 6. This simplified assembly will save assembly time compared to the state of the art, three component, square base wax barriers which must be trimmed and buffed after the hearing aid components are installed. Likewise, in alternative embodiments, the said base 4 could be made square, similar to the three piece barriers, such that the perimeter must be trimmed to match the contour of the hearing aid shell. Also, in an alternative embodiment, eliminating the cylindrical component 3 would require that the base 4 be adhered to the tip of the hearing instrument as both sides of the base would then be flat.

Figure 3:
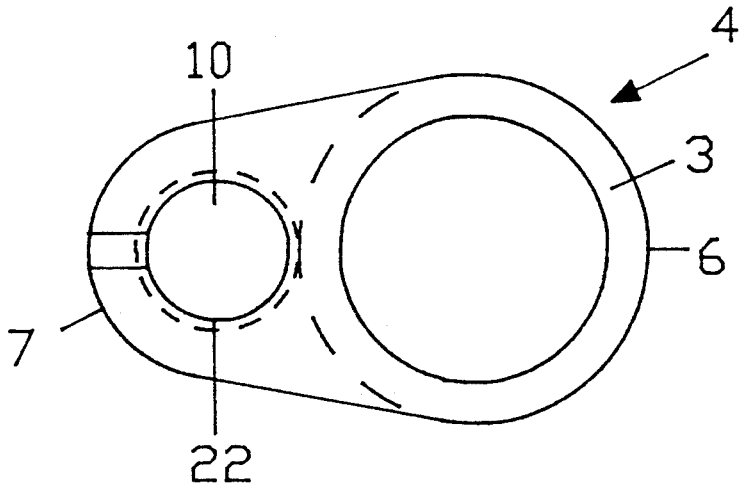
FIG. 3 is a top view of the sound outlet base.
Figure 5:
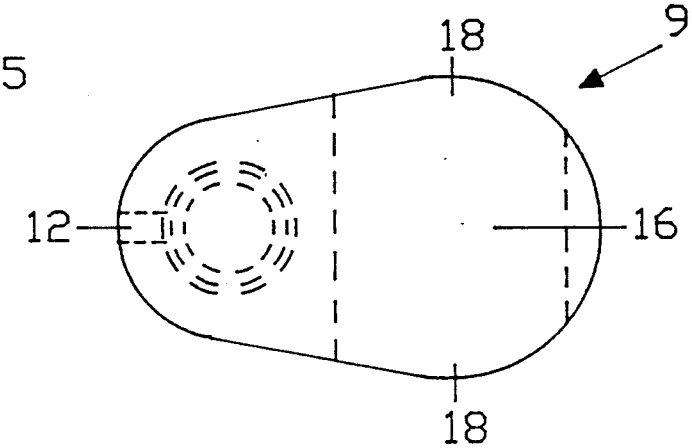
FIG. 5 is a top view of the barrier door.

The perimeter of the barrier door 9 is flush with the perimeter of the top of the sound outlet base 4 at the surface between the two components as can be shown from an overlay of FIGS. 3 and 5. In alternative embodiments, the barrier door 9 perimeter could be larger than the base 4 perimeter in order to reduce the amount of wax which could migrate above the base.

From FIG. 1 the barrier door 9 of the preferred embodiment comprises a sound outlet channel 16 which allows the sound to exit the tubing 14 and then exit both sides 18 of the barrier door. The channel 16 in the door is approximately 0.016 inch height by 0.079 inch width at each of the sound exits 16. As shown in FIG. 4 the channel has a 0.016 inch radius along each edge 17 in contact with the base 4 in order to ease the molding process. If cerumen should migrate near the exits of the sound channel 16, the wearer can clean with a small brush or wire loop typically provided by the hearing aid dispenser.

From FIGS. and 6 wax must clog the exits 18 of the sound channel 16 before it can migrate to the tip of the tubing 15. This will reduce the intrusion of wax into the sound outlet port of the tubing 16 and ultimately, the transducer 13. With the present invention, replacement filters are not needed and wearers Would benefit from the reduced number of costly repairs and trips to their hearing aid dispenser. The sound outlet channel 16 of the barrier door 9 as shown in FIG. 4 can be designed in many shapes and sizes which would not significantly affect the output of the hearing instrument. These alternative embodiments should not detract from the novelty of said invention, as an extreme number of channels may be designed in the barrier door which would allow the sound to exit the hearing aid significantly unaltered. Adjusting the shape or number of such exit channels is considered to be obvious by the inventor. However, the preferred embodiment is chosen for illustration because of its simplicity.

The top of the barrier door 19 is approximately 0.032 inch high from the top of the base 5 when inserted in the base as shown in FIG. 6. The surface of the top of the door 19 is contoured to reduce the amount of edges which could contact the skin of the ear canal during insertion and create discomfort for the wearer. Again the inventor recognizes many contours which could be designed which would still prevent the intrusion of wax into the sound outlet port. The contour illustrated is of the preferred embodiment and prevents the barrier door 9 from "scooping" wax upon insertion.

The male component 8 of the barrier door 9 snaps into the counter-bore 10 of the base shown in FIG. 6. As illustrated in FIG. 4, the male component 8 comprises a solid cylinder 20 and a cap 21. The cylinder 20 is 0.040 inch diameter and 0.017 inch height. At the intersection of the cap 21 and the cylinder 20, the cap has a diameter of 0.046 inch. As illustrated in FIG. 3 the maximum cap diameter is greater than the diameter of the top hole 22 in the counter-bore 10 and will thus prevent the barrier door 9 from falling out of the base 4.

The cap 21 as shown in FIG. 4 is tapered resulting in a tip with a diameter of 0.031 inch. The height of the cap 21 is 0.013 inch. The combination of the cylinder 20 and the cap 21 is 0.030 inch height which matches the height of the sound outlet base 23 at the counter-bore 10 as shown in FIG. 2. The cap 21 will likely break apart from the cylinder 20 if the barrier door 9 is removed from the base 4 once assembled as illustrated in FIG. 6. The other likely scenario would be the cylinder 20 breaking off at the door 9. In each case, the barrier door 9 would not be connected to the base 4 and could not fall into the ear canal as the wearer could not hold the barrier door 9 onto the base 4 and insert simultaneously. However, the wearer could continue to use the hearing instrument without the barrier door 9 but would lose the benefit of a cerumen barrier.

In alternative embodiments, variations in the diameter of the male component 8 of FIG. 4 can affect the torque needed to rotate the barrier door 9 and therefore the cylinder 20 within the counter-bore 10 of FIG. 2. Variations in diameter of the cap 21 can affect the force needed to snap the barrier door 9 into the counter-bore 10 and the force needed to remove (thus breaking) the barrier door 9 from the base 4 as shown in FIG. 6.

The rotation of the barrier door 9 within the counter-bore 10 poses no threat to the wearer's ear drum if the wearer attempts to insert the hearing instrument when said door is open. When the said door is open (detent not engaged), it does not extend the effective length of the hearing aid (along the long axis of the ear canal). When the barrier door 9 is open, it will likely extend beyond the perimeter of the hearing aid tip making insertion uncomfortable if not impossible. If the barrier door 9 rubs on the skin of the auricle (the visible outer ear), the wearer will likely inspect the hearing aid and close the door prior to full insertion.

The amount of stress and strain placed on the male component 8 of the barrier door 9 when opened and closed is minimized due to the rotational design. The male component 8 can rotate within the counter-bore 10 reducing significant fatigue on the cap 21 whereby greatly reducing the likelihood that the barrier door 9 will fall off the instrument or into the ear canal during use.

I claim:

1. A hearing instrument comprising:

a shell housing (1) including a sound outlet port (2);

a cerumen barrier having two components in combination:

a sound outlet base 4 comprising:

a bore defining the central axis for the passage of sound having a diameter which is at least about forty thousandths of an inch and at most about one hundred fifty thousandths of an inch; and a cylindrical component of sound passage (3) insertable into said sound outlet port (2), incorporating a bore of same diameter as the bore of the central axis, having depth which is at least ten thousandths of an inch and at most about one hundred thousandths of an inch extended from the base (4), where the central axis for the passage of sound is therefore extended defined by the interior wall surface of said cylindrical component; and a counter-bore (10) having at minimum about five thousandths of an inch diameter and at maximum about one hundred twenty thousandths of an inch diameter, having depth which is at minimum about five thousandths of an inch and at maximum about one hundred thousands of an inch; and a detent cavity (11) which will accept a projecting detent of a minimum of about one thousandths of an inch radius and a maximum of about fifteen thousandths of an inch radius having at a minimum of about zero length (spherically shaped) to a maximum of about thirty thousandths of an inch (cylindrical surface area); and a base (4) perimeter which is, at the minimum, limited by the outside perimeter of the bore defining the central axis for the passage of sound and the outside perimeter of the counter-bore (10), and at the maximum, a perimeter which is very large in comparison to said bore diameter, exceeding the tip diameter of the shell housing (1), thereby requiring trimming of said base (4) perimeter to match the contour of the hearing aid shell; and a barrier door (9) which is defined by:

a male connector (8) which is fitted into the counter-bore (10) of the base component (4) and having a solid cylinder (20) with a cap (21) at the end of said cylinder where the cap has a maximum diameter which is greater than the diameter of the smaller top hole in the counter-bore (10), which in cooperation with the barrier door (9), rotates said connector within the base (4); and a detent (12) which projects from the bottom surface of the barrier door (9) which in cooperation with the base detent cavity (11) properly aligns the door (9) and the base (4) such that their respective perimeters are flush; and a sound outlet channel (16), positioned above the cylindrical component (3) when the barrier door (9) is properly aligned, which width is at a minimum of about thirty thousandths of an inch and at a maximum of about one hundred fifty thousandths of an inch, and height at a minimum of about five thousandths of an inch and at a maximum of about thirty thousandths of an inch, and length extending such that sound may exit both sides of the barrier door (9) when said door is properly aligned; and a height at a minimum of about ten thousandths of an inch and at a maximum of about one hundred thousandths of an inch; and a top surface area which is contoured to disallow any significant edges which can contact the ear canal creating discomfort during insertion; and a perimeter of the said door (9) which is at a minimum, flush with the perimeter of top of the said base (4) at the surface between the two components, and at a maximum, as large as the perimeter of the tip of the shell housing (1).

2. A hearing instrument according to claim 1 wherein said male connector has a polyhedron surface rather than a cylindrical surface.

3. A hearing instrument according to claim 1 wherein said male connector has a cap which has a polyhedron surface rather than a conical surface.

4. A cerumen barrier for in the ear-type hearing instruments, comprising a member having a cylindrical component dimensioned for insertion into the cylindrical sound outlet port of an in the ear-type hearing instrument, with the cylindrical component having a bore for permitting passage of sound, the member further including a barrier door fitted to the cylindrical component and rotatable between a closed position over the sound outlet bore of the cylindrical component and an open position exposing the sound outlet bore, the barrier door being fixed to the cylindrical component on an axis generally parallel with the sound outlet bore.

5. The apparatus recited in claim 4, wherein the barrier door further comprises a sound outlet channel along a peripheral edge thereof and adjacent to the cylindrical component when the barrier door is in the closed position.

6. A method for permitting removal of cerumen accumulation in a hearing instrument of the type having a cylindrical sound outlet port, the method comprising the steps of:

providing a member having a cylindrical component dimensioned for insertion into the cylindrical sound outlet port and with the cylindrical component having a bore for permitting passage of sound, the member having a barrier door fitted to the cylindrical component and rotatable between a closed position over the sound outlet bore of the cylindrical component and an open position exposing the sound outlet bore;

inserting the cylindrical component in the sound outlet port; and thereafter rotating the barrier door as required to expose the sound outlet bore for removal of cerumen.

7. The method recited in claim 6 wherein the rotating step comprises rotating the barrier door about an axis generally parallel with the sound outlet bore.

8. A hearing instrument comprising:

a shell housing (1) including a sound outlet port (2) and a tip;

a cerumen barrier having two components in combination:

a sound outlet base (4) comprising:

a bore defining the central axis for the passage of sound having a diameter which is at least about forty thousandths of an inch and at most about one hundred fifty thousandths of an inch;

a flat bottom affixed to the tip of the shell housing (1);

a counter-bore (10) having at minimum about five thousandths of an inch diameter and at maximum about one hundred twenty thousandths of an inch diameter, having depth which is at minimum about five thousandths of an inch and at maximum about one hundred thousandths of an inch;

a detent cavity (11) which will accept a projecting detent of a minimum of about one thousandths of an inch radius and a maximum of about fifteen thousandths of an inch radius having at a minimum of about zero length (spherically shaped) to a maximum of about thirty thousandths of an inch (cylindrical surface area); and a base (4) perimeter which is, at the minimum, limited by the outside perimeter of the bore defining the central axis for the passage of sound and the outside perimeter of the counter-bore (10), and at the maximum, a perimeter which is very large in comparison to said bore diameter, exceeding the tip diameter of the shell housing (10), thereby requiring trimming of said base (4) perimeter to match the contour of the hearing aid shell;

a barrier door (9) which is defined by:

a male connector (8) which is fitted into the counter-bore (10) of the base component (4) and having a solid cylinder (20) with a cap (21) at the end of said cylinder where the cap has a maximum diameter which is greater than the diameter of the smaller top hole in the counter-bore (10), which in cooperation with the barrier door (9), rotates said connector within the base (4);

a detent (12) which projects from the bottom surface of the barrier door (9) which in cooperation with the base detent cavity (11) properly aligns the door (9) and the base (4) such that their respective perimeters are flush;

a sound outlet channel (16), positioned above the sound outlet port (2) when the barrier door (9) is properly aligned, which width is at a minimum of about thirty thousandths of an inch and at a maximum of about one hundred fifty thousandths of an inch, and a height at a minimum of about five thousandths of an inch and at a maximum of about thirty thousandths of an inch, and length extending such that sound may exit both sides of the barrier door (9) when said door is properly aligned;

a height at a minimum of about ten thousandths of an inch and at a maximum of about one hundred thousandths of an inch;

a top surface which is contoured to disallow any significant edges which can contact the ear canal creating discomfort during insertion; and a perimeter of said door (9) which is at a minimum, flush with the perimeter of top of said base (4) at the surface between the two components, and at a maximum, as large as the perimeter of the tip of the shell housing (1).

9. A cerumen barrier for an in the ear type hearing instrument having a cylindrical sound outlet port that reduces cerumen clogging during insertion comprising:

a member having a cylindrical component dimensioned for insertion into the cylindrical sound outlet port and with the cylindrical component having a bore for permitting passage of sound, the bore having a longitudinal axis; and a barrier door fitted in spaced relation to the cylindrical component to form a channel therebetween, the barrier door substantially perpendicular to the longitudinal axis of the bore;

the barrier door providing a surface for blocking cerumen from entering the sound outlet port during insertion and the spaced relationship of the barrier door to the cylindrical component permitting the passage of sound into the hearing instrument;

the barrier door being rotatable between a closed position over the sound outlet bore of the cylindrical component and an open position exposing the sound outlet bore; and wherein the apparatus can be cleaned by rotating the barrier door from the closed position to the open position and removing accumulated cerumen from the apparatus.

10. The apparatus recited in claim 9, wherein the barrier door is rotatable in a plane generally coplanar with the barrier door.

11. The apparatus recited in claim 10, wherein:

the member further has a counter-bore generally parallel to the bore of the cylindrical component;

the barrier door has a generally cylindrical male connector dimensioned to pivotally engage the counter-bore: and the barrier door rotation comprises pivoting of the male connector within the counter-bore.

* * * * *